US007934547B2

(12) United States Patent
Milkovisch et al.

(10) Patent No.: US 7,934,547 B2
(45) Date of Patent: May 3, 2011

(54) APPARATUS AND METHODS TO CONTROL FLUID FLOW IN A DOWNHOLE TOOL

(75) Inventors: Mark Milkovisch, Cypress, TX (US); Alexander F. Zazovsky, Houston, TX (US); Stephane Briquet, Houston, TX (US); Christopher S. Del Campo, Houston, TX (US); Raymond V. Nold, III, Beasley, TX (US); Jonathan W. Brown, Nolsy le Rol (FR); Kenneth L. Havlinek, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 219 days.

(21) Appl. No.: 11/840,429

(22) Filed: Aug. 17, 2007

(65) Prior Publication Data

US 2009/0044951 A1 Feb. 19, 2009

(51) Int. Cl.
*E21B 43/00* (2006.01)

(52) U.S. Cl. ..... 166/105; 166/68

(58) Field of Classification Search ..... 166/66.4, 166/68, 105; 417/423.5, 426, 2, 3
See application file for complete search history.

(56) References Cited

U.S. PATENT DOCUMENTS 3,985,472 A * 10/1976 Virtue et al. ..... 417/216
4,573,532 A 3/1986 Blake
5,423,229 A * 6/1995 Schultz et al. ..... 73/863
2005/0034871 A1 2/2005 Scarsdale
2006/0042793 A1 3/2006 Del Campo et al.
2006/0168955 A1 8/2006 Longfield et al.
2008/0152517 A1 * 6/2008 Ishii et al. ..... 417/423.5

FOREIGN PATENT DOCUMENTS

GB 2304906 3/1997
GB 2415718 1/2006

OTHER PUBLICATIONS

Proett et al., "New-dual-probe wireless formation testing and sampling tool enables real-time permeability and anisotropy measurements," *2000 SPE Permian Basin Oil and Gas Recovery Conference*, Paper 59701, Midland, Texas, Mar. 21-23, 2000.

* cited by examiner

*Primary Examiner* — Kenneth Thompson
*Assistant Examiner* — James G. Sayre
(74) *Attorney, Agent, or Firm* — Dave R. Hofman

(57) ABSTRACT

Apparatus and methods to control fluid flow in a downhole tool are disclosed. A disclosed example system includes a hydraulically actuatable device having a cavity for receiving pressurized hydraulic fluid stored by a reservoir, a first and a second hydraulic pump, a motor and means for selectively flowing hydraulic fluid from the outlet of at least one of the first and second pumps to the at least one cavity. The first and second hydraulic pumps include an inlet fluidly coupled to the reservoir and an outlet fluidly coupled to the cavity, and the motor is operatively coupled to at least one of the pumps.

17 Claims, 11 Drawing Sheets

APPARATUS AND METHODS TO CONTROL FLUID FLOW IN A DOWNHOLE TOOL

FIELD OF THE DISCLOSURE

The present disclosure relates generally to borehole tool systems and, more particularly, to apparatus and methods to control fluid flow in a downhole tool.

BACKGROUND

Reservoir well production and testing involves drilling subsurface formations and monitoring various subsurface formation parameters. Drilling and monitoring typically involves using downhole tools having electric-power, mechanic-power, and/or hydraulic-power devices. To power downhole tools using hydraulic power, pump systems are used to pump hydraulic fluid. Pump systems may be configured to draw hydraulic fluid from a reservoir and pump the fluid to create a particular pressure and flow rate to provide necessary, hydraulic power. The pump systems can be controlled to vary output pressures and/or flow rates to meet the needs of particular applications. In some example implementations, pump systems may also be used to draw and pump formation fluid from subsurface formations. A downhole string (e.g., a drill string, a wireline string, etc.) may include one or more pump systems depending on the operations to be performed using the downhole string. Traditional pump systems are limited in their operation by the range of flow rates that can be achieved. Examples of pump systems for a downhole tool positionable in a wellbore penetrating a subterranean formation can be found in U.S. Patent Application Pub. Nos. 2005/0034871, 2006/0042793 and 2006/0168955. Other examples of pump systems for a downhole tool positionable in a wellbore penetrating a subterranean formation can be found in "New Dual-Probe Wireline Formation Testing and Sampling Tool Enables Real-Time Permeability, and Anisotropy Measurements", SPE 59701, 21-23 Mar. 2000 by Proett and al. or in the brochure of the Reservoir Characterization Instrument (RCI$^{SM}$) commercialized by Baker Hughes, 2000.

SUMMARY

In accordance to one exemplary embodiment, a pumping system is disclosed. The pumping system includes a hydraulically actuatable device including at least one cavity for receiving pressurized hydraulic fluid and a reservoir for storing the hydraulic fluid. A first and second hydraulic pump include an inlet fluidly coupled to the reservoir and an outlet fluidly coupled to the at least one cavity. At least one motor is operatively coupled to at least one of the first and second hydraulic pumps. In addition, the system includes means for selectively flowing hydraulic fluid from the outlet of at least one of the first and second pumps to the at least one cavity.

In accordance to another exemplary embodiment, a pumping method is disclosed. The method includes providing a hydraulically actuatable device including at least one cavity for receiving pressurized hydraulic fluid; providing a pump system having a reservoir for storing hydraulic fluid, a first hydraulic pump having an inlet fluidly coupled to the reservoir and an outlet fluidly coupled to the cavity, and a second hydraulic pump having an inlet fluidly coupled to the reservoir and an outlet fluidly coupled to the cavity; pumping hydraulic fluid into the cavity using the first pump; pumping hydraulic fluid from the reservoir using the second pump; actuating the first pump and the second pump via at least one motor; and selectively pumping hydraulic fluid to the cavity using the second pump.

In accordance to one exemplary embodiment, a pumping system is disclosed. The pumping system includes a hydraulically actuatable device including at least one cavity for receiving pressurized hydraulic fluid and a reservoir for storing the hydraulic fluid. A first hydraulic pump has a first operating range with an inlet fluidly coupled to the reservoir and an outlet fluidly coupled to the at least one cavity. A second hydraulic pump has a second operating range substantially different from the first operating range with an inlet fluidly coupled to the reservoir and an outlet fluidly coupled to the at least one cavity, wherein the second pump is configured to flow fluid when actuated in a first direction and substantially not to flow fluid when actuated in a second direction. The system further includes at least one motor for actuating the first and second hydraulic pumps able to selectively rotate in one of the first and the second direction, and a shaft operatively coupling the at least one motor and the first pump and the second pumps.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
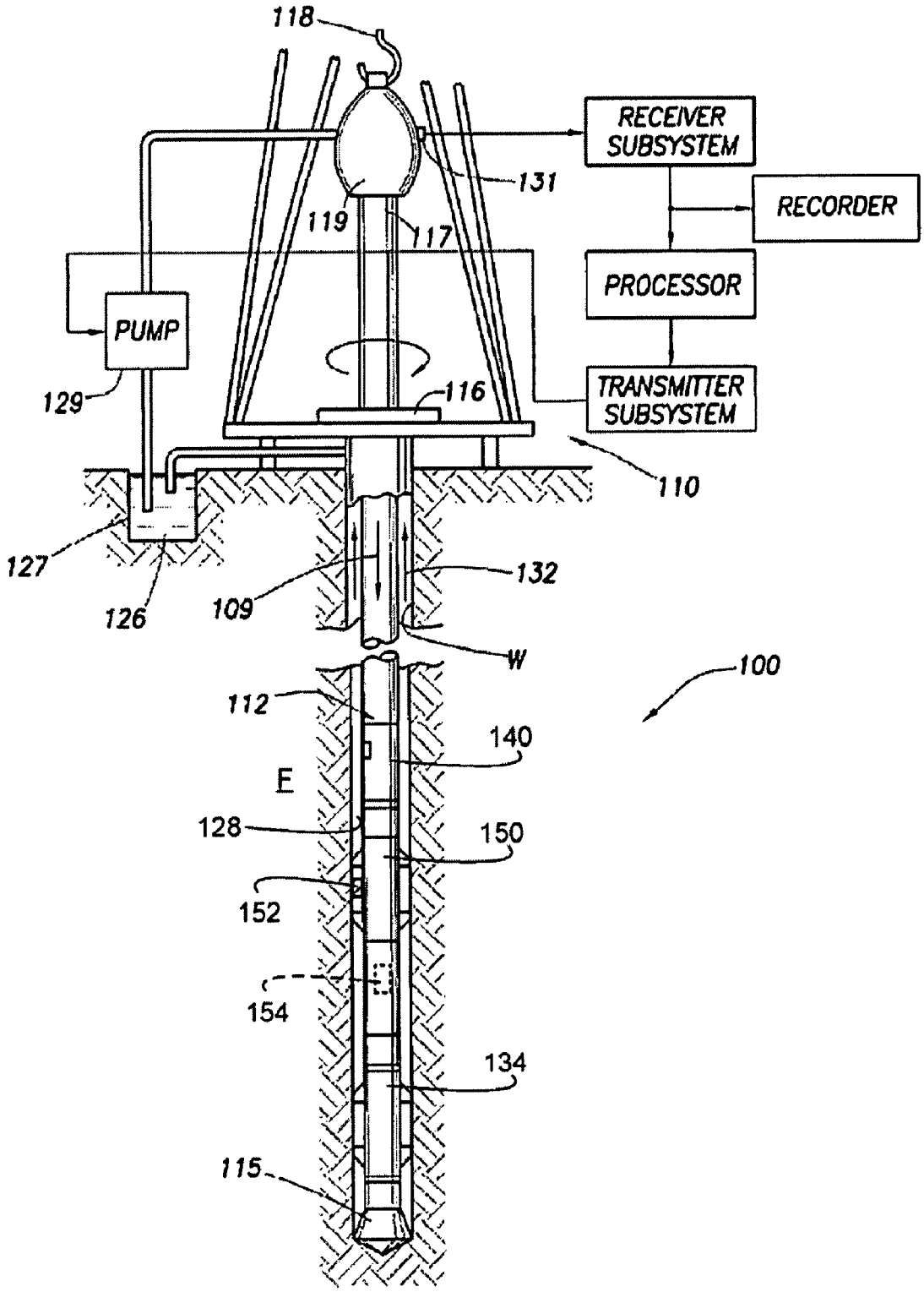
FIG. 1 illustrates an elevational view of a drilling rig and drill string that may be configured to use the example apparatus and methods described herein.

FIG. 1 illustrates an example drilling rig 110 and a drill string 112 in which the example apparatus and methods described herein can be used to control fluid flow associated with, for example, drawing formation fluid samples from a subsurface formation F. In the illustrated example, a land-based platform and derrick assembly 110 are positioned over a wellbore W penetrating the subsurface formation F. In the illustrated example, the wellbore W is formed by rotary drilling in a manner that is well known. Those of ordinary skill in the art given the benefit of this disclosure will appreciate, however, that the apparatus and methods described herein also finds application in directional drilling applications as well as rotary drilling, and is not limited to land-based rigs.

The drill string 112 is suspended within the wellbore W and includes a drill bit 115 at its lower end. The drill string 112 is rotated by a rotary table 116, which engages a kelly 117 at an upper end of the drill string 112. The drill string 112 is suspended from a hook 118, attached to a traveling block (not shown) through the kelly 117 and a rotary swivel 119, which permits rotation of the drill string 112 relative to the hook 118.

A drilling fluid or mud 126 is stored in a pit 127 formed at the well site. A pump 129 is provided to deliver the drilling fluid 126 to the interior of the drill string 112 via a port (not shown) in the swivel 119, inducing the drilling fluid 126 to flow downwardly through the drill string 112 in a direction generally indicated by arrow 109. The drilling fluid 126 exits the drill string 112 via ports (not shown) in the drill bit 115, and then the drilling fluid 126 circulates upwardly through an annulus 128 between the outside of the drill string 112 and the wall of the wellbore W in a direction generally indicated by arrows 132. In this manner, the drilling fluid 126 lubricates the drill bit 115 and carries formation cuttings up to the surface as it is returned to the pit 127 for recirculation.

The drill string 112 further includes a bottom hole assembly 100, near the drill bit 115 (e.g., within several drill collar lengths from the drill bit 115). The bottom hole assembly 100 includes drill collars described below to measure, process, and store information. The bottom hole assembly 100 also includes a surface/local communications subassembly 140 to exchange information with surface systems.

In the illustrated example, the drill string 112 is further equipped with a stabilizer collar 134. Stabilizing collars are used to address the tendency of the drill string 112 to "wobble" and become decentralized as it rotates within the wellbore W, resulting in deviations in the direction of the wellbore W from the intended path (e.g., a straight vertical line). Such wobble can cause excessive lateral forces on sections (e.g., collars) of the drill string 112 as well as the drill bit 115, producing accelerated wear. This action can be overcome by providing one or more stabilizer collars to centralize the drill bit 115 and, to some extent, the drill string 112, within the wellbore W.

In the illustrated example, the bottom hole assembly 100 is provided with a probe tool 150 having a probe 152 to draw formation fluid from the formation F into a flow line of the probe tool 150. A pump system 154 is provided to create a fluid flow and/or to provide hydraulic fluid power to devices, systems, or apparatus in the bottom hole assembly 100. In particular, the pump system 154 may be utilized for energizing a displacement unit (not shown), that is in turn used for drawing formation fluid via the probe tool 150. In the illustrated example, the pump system 154 may, be implemented using the example apparatus and methods described herein to control hydraulic fluid flow in the probe tool 150. For example, the pump system 154 can be implemented using the example pump systems described below in connection with FIGS. 6-13. The pump system 154 may include two or more hydraulic pumps.

The example apparatus and methods described herein are not restricted to drilling operations. The example apparatus and methods described herein can also be advantageously used during, for example, well testing or servicing and other oilfield services related applications. Further, the example methods and apparatus can be implemented in connection with testing conducted in wells penetrating subterranean formations and in connection with applications associated with formation evaluation tools conveyed downhole by any known means.

Figure 2:
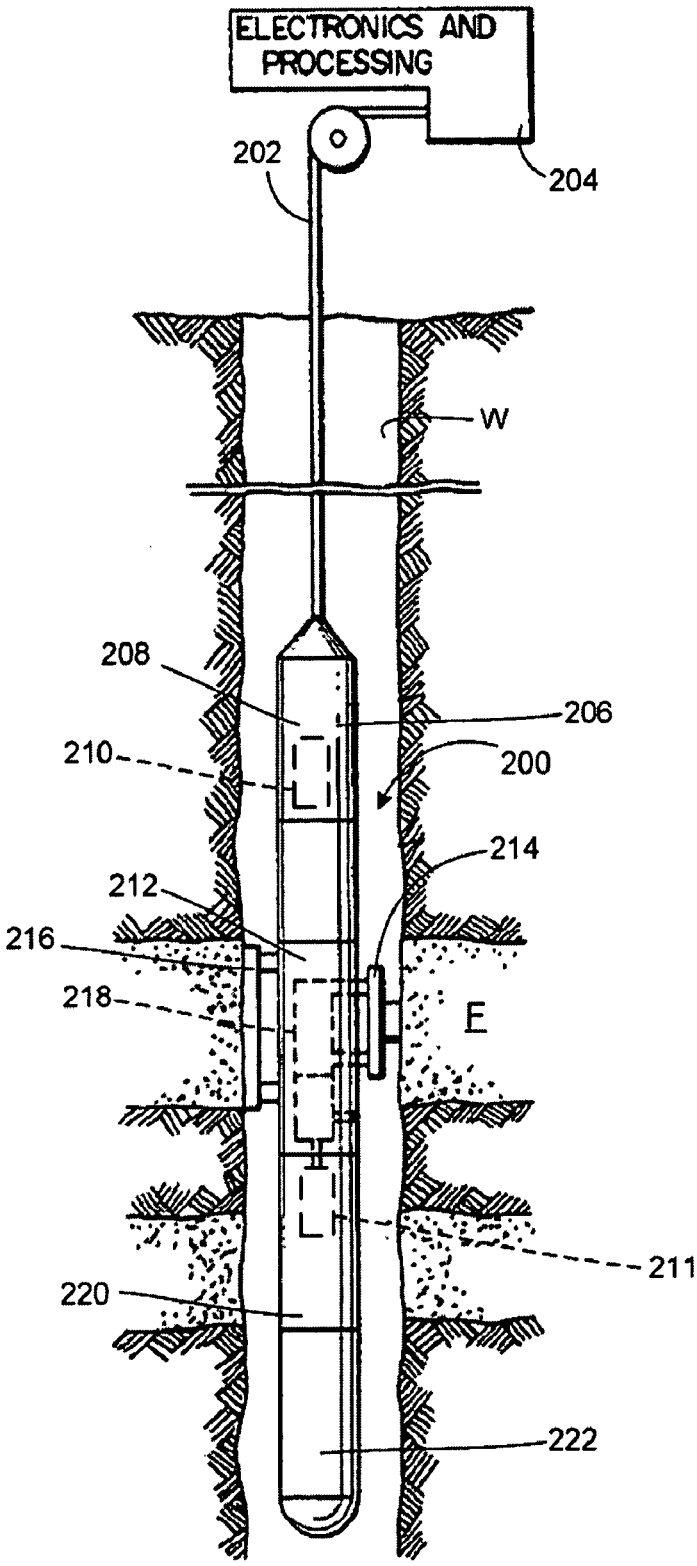
FIG. 2 illustrates an elevational view of a well bore with an example borehole tool suspended in the wellbore that may be configured to use the example apparatus and methods described herein.

FIG. 2 depicts an example borehole tool 200 for drawing formation fluid from the formation F and storing the fluid and/or analyzing the composition of fluid. In the illustrated example, the tool 200 is suspended in the wellbore W from the lower end of a multiconductor cable 202 that is spooled on a winch (not shown) at the earth's surface. On the surface, the cable 202 is communicatively coupled to an electrical control system 204. The tool 200 includes an elongated body 206 that includes a control module 208 having a downhole portion of a tool control system 210 configured to control an example pump system 211. The pump system 211 may be used to pump hydraulic fluid to create different fluid flow rates and pressures to provide fluid power to devices, systems, or apparatus in the borehole tool 200, and thereby, extract formation fluid from the formation F, for example. The control system 210 may also be configured to analyze and/or perform other measurements.

The elongated body 206 also includes a formation tester 212 having a selectively extendable fluid admitting assembly 214 and a selectively extendable tool anchoring member 216 that are respectively arranged on opposite sides of the body 206. The fluid admitting assembly 214 is configured to selectively seal off or isolate selected portions of the wall of wellbore W so that pressure or fluid communication with the adjacent formation F is established to draw fluid samples from the formation F. The formation tester 212 also includes a fluid analysis module 218 through which the obtained fluid samples flow. The fluid may thereafter be expelled through a port (not shown) or it may be sent to one or more fluid collecting chambers 220 and 222, which may receive and retain the fluids obtained from the formation F for subsequent testing at the surface or a testing facility. Although the downhole control system 210 and the pump system 211 are shown as being implemented separate from the formation tester 212, in some example implementations, the downhole control system 210 and the pump system 211 may be implemented in the formation tester 212.

Figure 3:
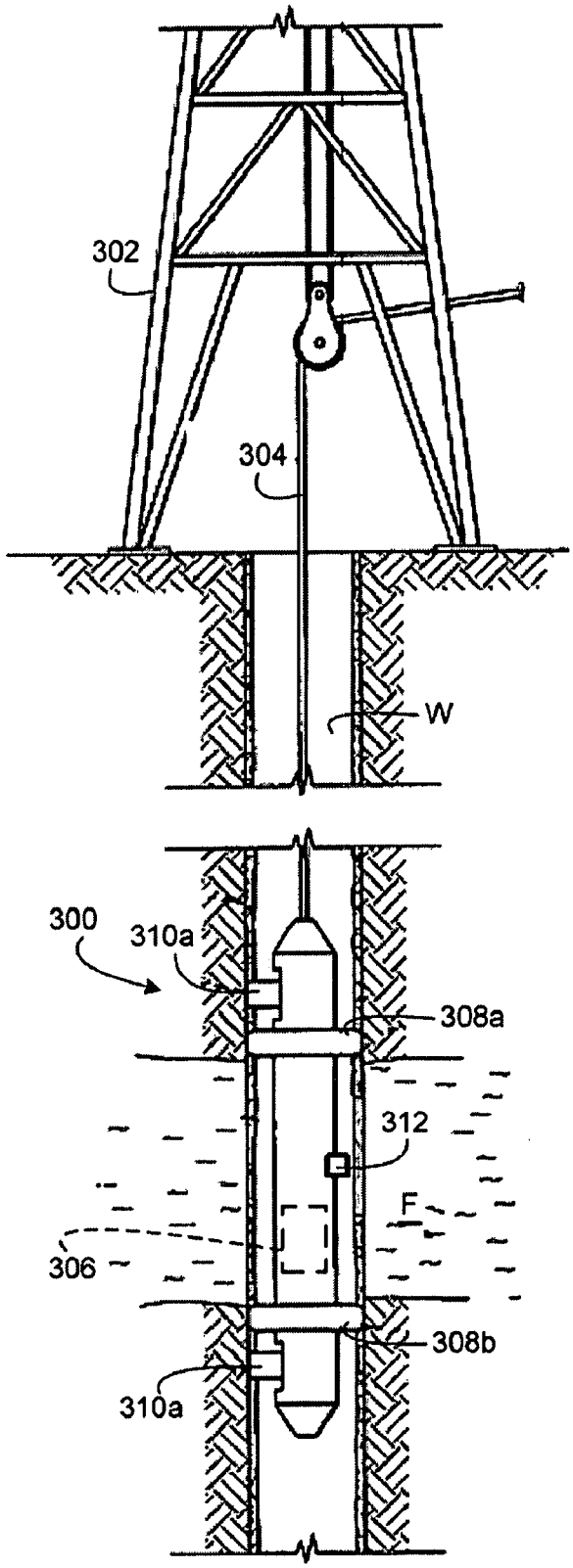
FIG. 3 illustrates an elevational view of a wellbore with another example borehole tool suspended in the wellbore that may be configured to use the example apparatus and methods described herein.

FIG. 3 depicts another example borehole tool 300 that may be used to perform stress testing and/or to inject materials into the formation F. In the illustrated example, the borehole tool 300 is suspended in the wellbore W from a rig 302 via a multiconductor cable 304. The borehole tool 300 is provided with a pump system 306 that may be implemented using the example apparatus and methods described herein. In addition, the borehole tool 300 is provided with packers 308*a-b* that are configured to inflate to seal off a portion of the wellbore W. In addition, to test the formation F, the borehole tool 300 is provided with one or more probe or outlet 312 that can be configured to inject materials (i.e. fluids) into sealed interval and/or into the formation F.

Figure 4A:
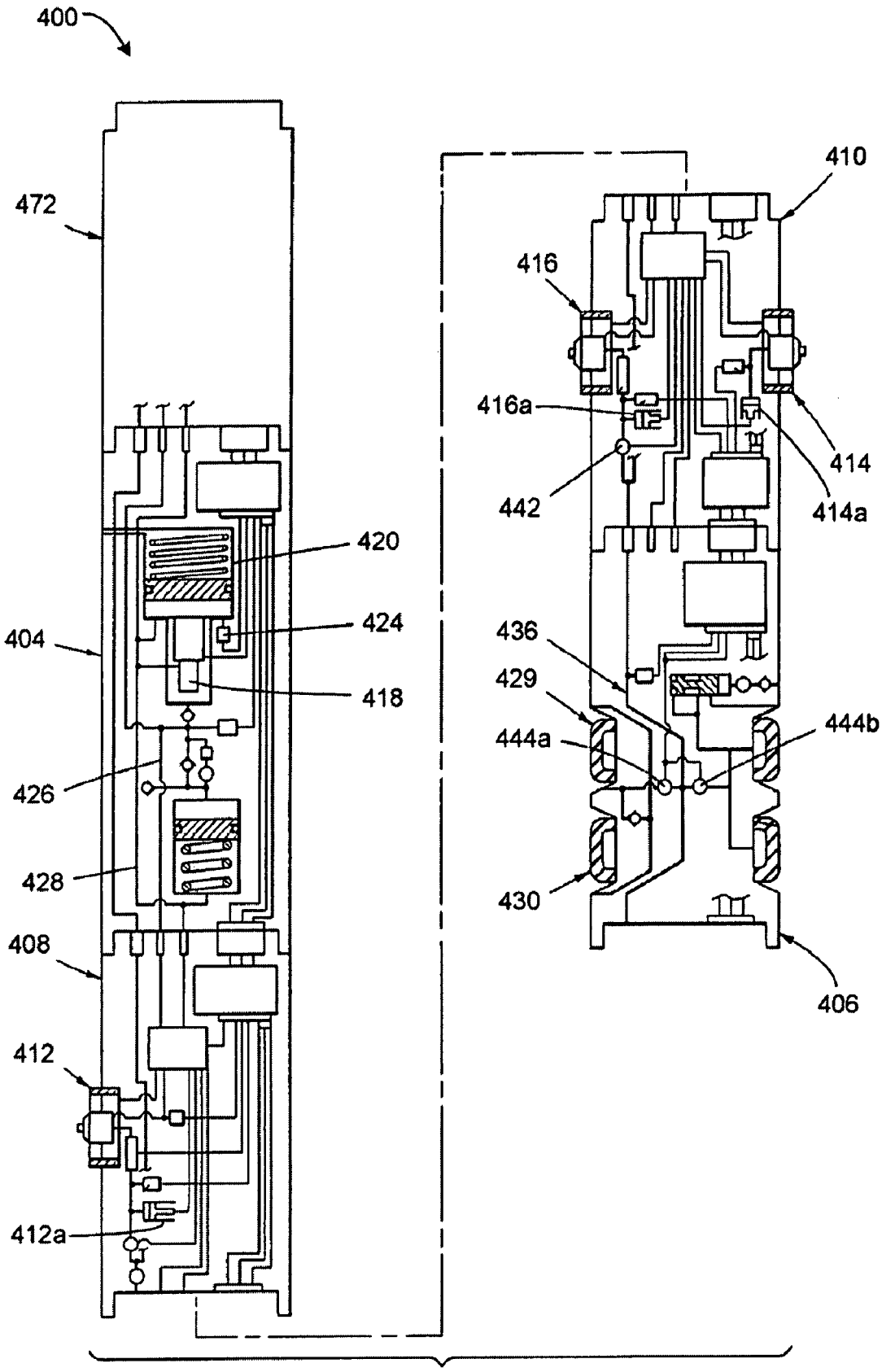
FIGS. 4A and 4B illustrate a block diagram of an example downhole tool that may be used in the example downhole tool of FIGS. 2-3 to implement the example apparatus and methods described herein.
Figure 4B:
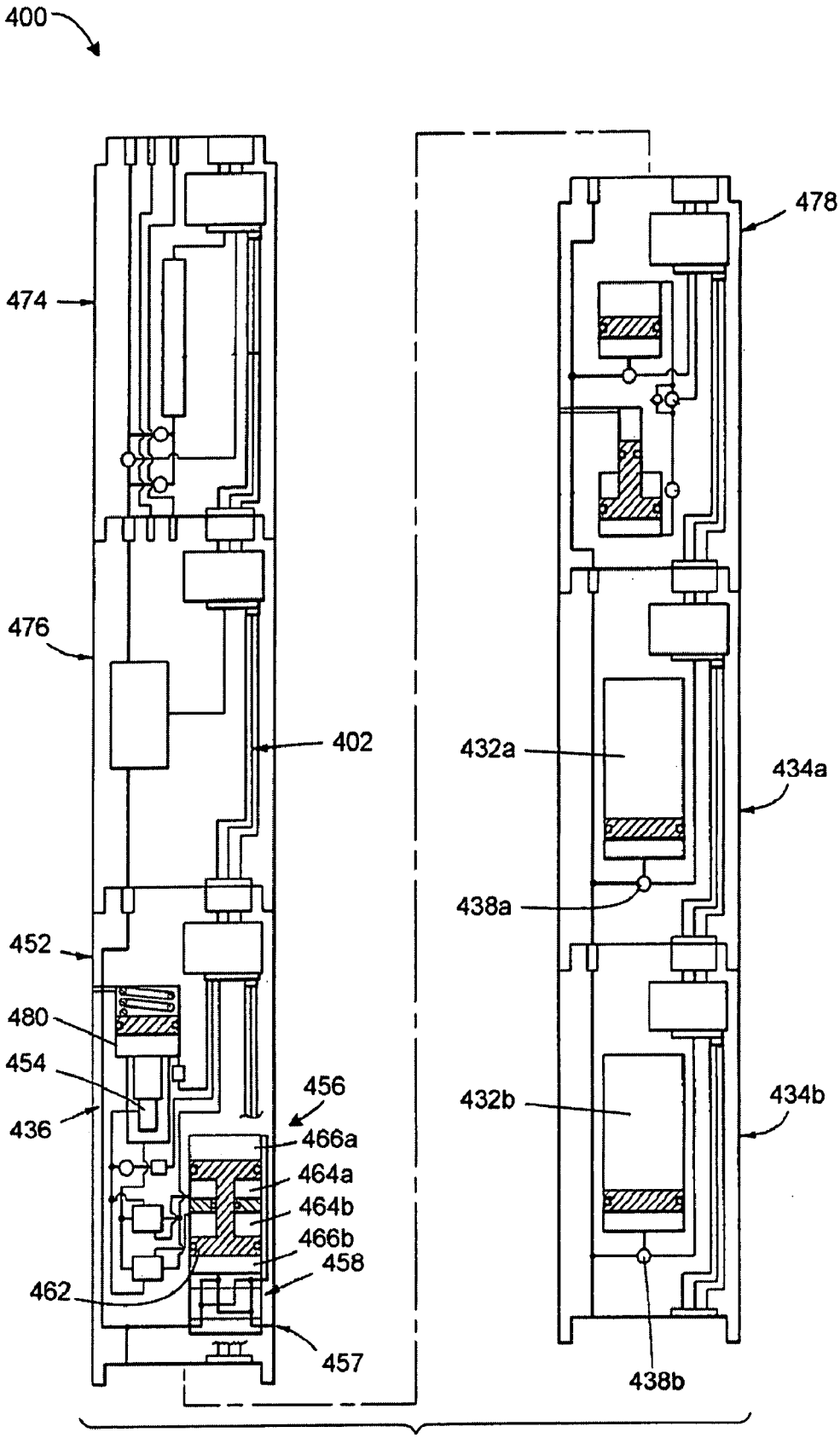

FIGS. 4A and 4B illustrate an example downhole tool 400 including a plurality of modules that may be used to implement the example apparatus and methods described herein. In the illustrated example, the portion of the example tool 400 depicted in FIG. 4A can be coupled to the portion of the example tool 400 depicted in FIG. 4B by, for example, coupling the lowermost collar or module of the tool portion of FIG. 4A to the uppermost collar or module of the tool portion of FIG. 4B. Although the example tool 400 is illustrated and described as being implemented using a modular configuration, in other example implementations, the example tool 400 may be implemented using a unitary tool configuration. The example tool 400 can be used to implement any of the example downhole tools of FIGS. 2-3 to, for example, extract formation fluid from the formation F and/or conduct formation property tests. Power and communication lines extend along the length of the example tool 400 and are generally referred to by reference numeral 402 (FIG. 4B). The power supply and communication lines 402 are configured to transfer electrical power to electrical components of the example tool 400 and to communicate information within and outside of the example tool 400.

As shown in FIG. 4A, the example tool 400 includes a hydraulic power module 404, a packer module 406, a probe module 408, and a multiprobe module 410. The probe module 408 is shown with one probe assembly 412, which can be used to draw formation fluid and/or to test isotropic permeability of the formation F. The multiprobe module 410 includes a horizontal probe assembly 414 and a sink probe assembly 416, which can be used to draw formation fluid and/or to test anisotropic permeability. To control drawing of formation fluid via the probe assemblies 412, 414, and 416 and/or to control flow rate and pressure of hydraulic fluid and/or formation fluid in the example tool 400, the hydraulic power module 404 includes an example pump system 418 and a hydraulic fluid reservoir 420. For example, the example pump system 418 may be used to control whether the probe assemblies 412, 414, and 416 admit formation fluid or prevent formation fluid from entering the example tool 400. In addition, the example pump system 418 may be used to create different flow rates and fluid pressures necessary for operating other devices, systems, and apparatus in the example tool 400. The example tool 400 also includes a low oil switch 424 that can be used to regulate the operation of example pump system 418.

A hydraulic fluid line 426 is connected to the discharge of the pump system 418 and runs through the hydraulic power module 404 and into adjacent modules to provide hydraulic power. In the illustrated example, the hydraulic fluid line 426 extends through the hydraulic power module 404 into the packer module 406 and the probe module 408 and/or 410 depending upon whether one or both are used. The hydraulic fluid line 426 and a return hydraulic fluid line 428 form a closed loop. In the illustrated example, the hydraulic fluid line 428 extends from the probe module 408 (and/or 410) to the hydraulic power module 404 and terminates at the hydraulic fluid reservoir 420.

In some example implementations, the example pump system 418 may be used to provide hydraulic power to the probe module 408 and/or 410 via the hydraulic fluid line 426 and the return fluid line 428. In particular, the hydraulic power provided by the pump system 418 may be utilized for actuating the drawdown pistons 412*a*, 416*a* and 414*a* associated with the extendable probes 412, 416 and 414, respectively. The hydraulic power provided by the example pump system 418 may also be used for extending and/or retracting the extendable probes 412, 416 and/or 414. Alternatively or additionally, the hydraulic power provided by the example pump system 418 may be used for extending/retracting setting pistons (not shown on FIGS. 4A nor 4B).

Turning to FIG. 4B, the example tool 400 includes an example pump out module 452 having the formation fluid flow line 436 running therethrough. In the illustrated example, the pump out module 452 can be used to draw formation fluid from the formation F into the example tool 400. For example, the pump out module 452 may be used to draw formation fluid from the formation F into the flow line 436 until substantially clean formation fluid passes through a fluid analysis module. Alternatively or additionally, the pump out module 452 of the illustrated example can be used to expel downhole fluid (i.e. wellbore fluid) into the formation F.

To draw and/or expel fluid, the pump out module 452 is provided with a pump system 454 and a displacement unit 456 coupled to the pump system 454. In the illustrated example, formation fluid is drawn or expelled via a flow line 457 coupled to a control valve block 458. The control valve block 458 may include four check valves (not shown), as is well known to those skilled in the art. The displacement unit 456 includes a dumbbell-type piston 462, two hydraulic fluid chambers 464*a-b*, and two formation fluid chambers 466*a-b*. The pump system 454 operates to force fluid into and out of the hydraulic fluid chambers 464*a-b* in an alternating fashion to actuate the piston 462. As the piston 462 actuates, a first end of the piston 462 pumps formation fluid using the first formation fluid chamber 466*a* and a second end pumps formation fluid using the second formation fluid chamber 466*b*. In the illustrated example, the control valve block 458 is used to control the coupling of fluid paths between the displacement unit 456 and the flow lines 436 and 457 to enable one of the formation fluid chambers 466*a-b* or the displacement unit 456 to draw formation fluid and the other one of the formation fluid chambers 466*a-b* to expel formation fluid.

The example methods and apparatus described herein can be used to implement the example pump system 454 to control the flow rate and pressure of hydraulic fluid and/or formation fluid pumped through the example tool 400. In this manner, the example methods and apparatus can be used to vary fluid flow rates while maintaining different desired fluid pressures. However, it should be appreciated that other pump systems may be used instead of the exemplary embodiment shown in FIG. 4B. For example, formation fluid may be routed to the small side of piston 462, to the chambers (464*a-b*). Conversely, hydraulic fluid may be routed to the large side of piston 462, to the chamber (466*a-b*). This alternate embodiment may be useful for achieving a formation fluid flow rate lower than the hydraulic fluid flow rate.

To inflate and deflate the straddle packers 429 and 430 of FIG. 4A using the pump out module 452 of FIG. 4B, the pump out module 452 can be selectively enabled to activate the example pump system 454. In doing so, the check valves controlling the valve block 458 would operate to reverse the flow direction discussed above (FIG. 4B). In this particular instance, wellbore fluid is pumped into the tool via the flow line 457 and circulated through various modules via flow line 436. The valves 444*b* (FIG. 4A) can be controlled to route wellbore fluid to and/or from the packers 429 and 430 to selectively inflate and/or deflate the packers 429 and 430.

Those skilled in the art will appreciate that alternatively, the packer module 406 may be modified for having a pumping system (418 or 454) capable of directly inflating the packers 429 and 430 with hydraulic fluid.

Various configurations of the example tool 400 may be implemented depending upon the tasks and/or tests to be performed. To perform basic sampling, the hydraulic power module 404 can be used in combination with an electric power module 472, the probe module 408, and the sample chamber modules 434*a-b*. To perform reservoir pressure testing, the hydraulic power module 404 can be used in combination with the electric power module 472, the probe module 408, and a precision pressure module 474. For uncontaminated sampling at reservoir conditions, the hydraulic power module 404 can be used in combination with the electric power module 472, the probe module 408, a fluid analysis module 476, the pump out module 452, and the sample chamber modules 434*a-b*. To measure isotropic permeability, the hydraulic power module 404 can be used in combination with the electric power module 472, the probe module 408, the precision pressure module 474, a flow control module 478, and the sample chamber modules 434*a-b*. For anisotropic permeability measurements, the hydraulic power module 404 can be used with the probe module 408, the multiprobe module 410, the electric power module 472, the precision pressure module 474, the flow control module 478, and the sample chamber modules 434*a-b*. A simulated drillstem test (DST) can be run using the electric power module 472 in combination with the packer module 406, the precision pressure module 474, and the sample chamber modules 434*a-b*. Other configurations may also be used to perform other desired tasks or tests.

Figure 5:
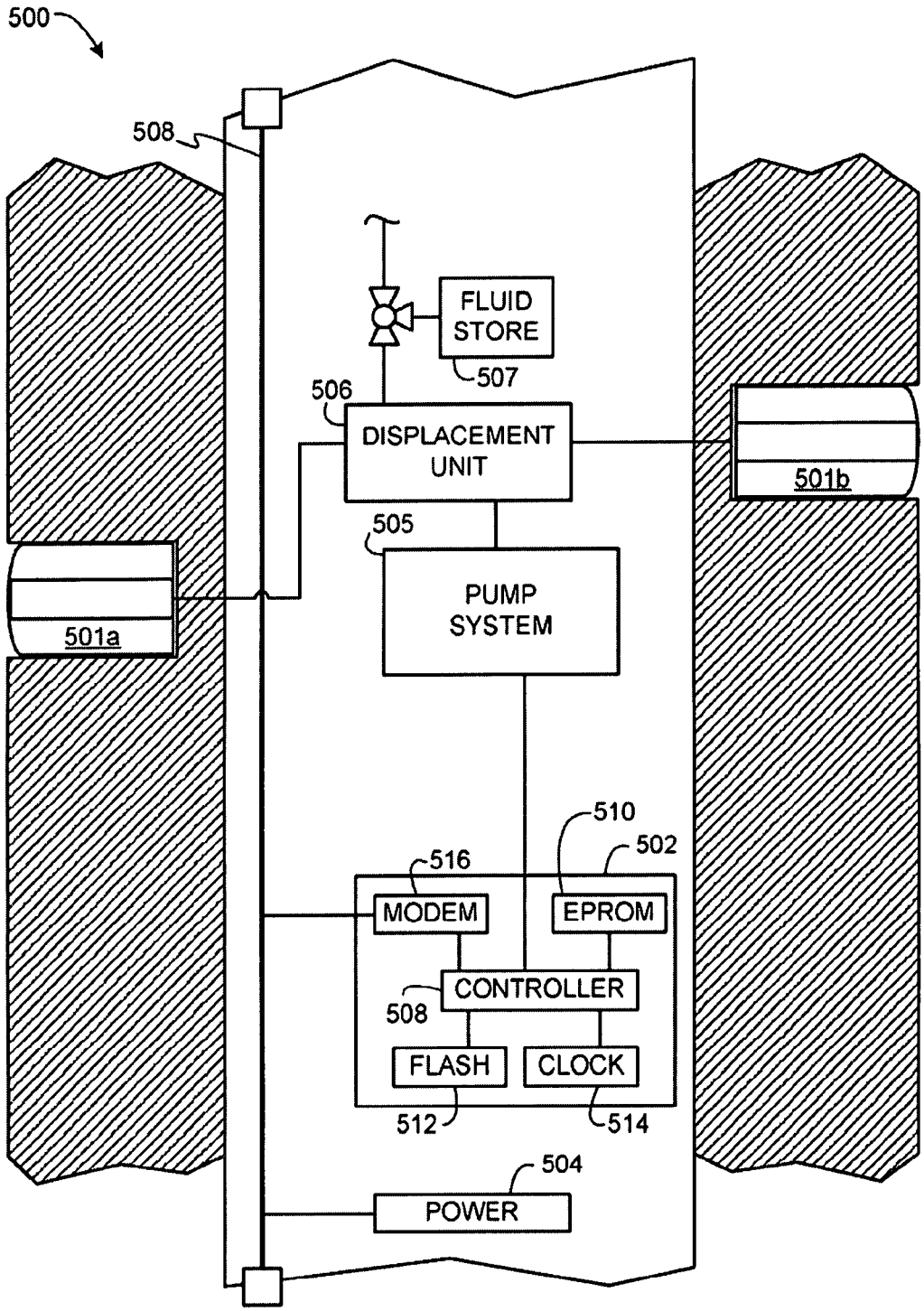
FIG. 5 is a block diagram of an example apparatus that may be used in the example downhole tool of FIG. 1 to implement the example apparatus and methods described herein.

FIG. 5 depicts a block diagram of an example apparatus 500 that may be implemented in the drill string 112 of FIG. 1, to control fluid flow rates and/or fluid pressures associated with, for example, hydraulic fluid and/or formation fluid from the formation F (FIG. 1). In the illustrated example of FIG. 5, lines shown connecting blocks represent fluid or electrical connections that may comprise one or more flow lines (e.g., hydraulic fluid flow lines or formation fluid flow lines) or one or more wires or conductive paths respectively. For clarity, some connections have not been drawn on FIG. 5.

The example apparatus 500 is provided with an electronics system 502 and a power source 504 (battery, turbine driven by drilling fluid flow 109, etc.) to power the electronics system 502. In the illustrated example, the electronics system 502 is configured to control operations of the example apparatus 500 to control fluid flow rates and/or fluid pressures to, for example, draw formation fluid from probes 501*a* and 501*b* and/or provide fluid power to other devices, systems, and/or apparatus. In the illustrated example, the electronics system 502 is coupled to a pump system 505 that may be substantially similar or identical to the example pump system 154 of FIG. 1, which may be implemented using one or more of the example pump systems described below in connection with FIGS. 6-12. The example pump system 505 is coupled to a displacement unit 506 and is configured to drive the displacement unit 506 to draw formation fluid via the probes 501*a-b*. The displacement unit 506 may be substantially similar or identical to the displacement unit 456 described above in connection with FIG. 4B. The electronics system 502 may, be configured to control formation fluid flow by controlling the operation of the pump system 505. The electronics system 502 may also be configured to control whether extracted formation fluid is stored in a fluid store 507 (e.g., sample chambers) or is routed back out of the example apparatus 500 (e.g., pumped back into the wellbore W of FIG. 1). Additionally, the electronics system 502 may be configured to control other operations of the probe tool 150 of FIG. 1, including, for example, test and analysis operations, data communication operations, etc. In the illustrated example, the power source 504 is connected to a tool bus 508 configured to transmit electrical power and communication signals.

The electronics system 502 is provided with a controller 508 (e.g., a CPU and Random Access Memory) to implement control routines such as, for example, routines that control the pump system 505. In some example implementations, the controller 508 may be configured to receive data from sensors (e.g., fluid flow sensors) in the example apparatus 500 and execute different instructions depending on the data received, such as analyzing, processing and/or compressing the received data, and the like. To store machine accessible instructions that, when executed by the controller 508, cause the controller 508 to implement control routines or any other processes, the electronics system 502 is provided with an electronic programmable read only memory (EPROM) 510.

To store test and measurement data, or any kind of data, acquired by the example apparatus 500, the electronics system 502 is provided with a flash memory 512. To implement timed events and/or to generate timestamp information, the electronics system 502 is provided with a clock 514. To communicate information when the example apparatus 500 is downhole, the electronics system 502 is provided with a modem 516 that is communicatively coupled to the tool bus 506 and the subassembly 140 (FIG. 1). In this manner, the example apparatus 500 may send data to and/or receive data from the surface via the subassembly 140 and the modem 516. Data may alternatively be downloaded when the testing tool is back to the surface via a read out port (not shown).

FIGS. 6-13 depict example pump systems that may be used to implement the example pump systems 154, 211, 306, 418, 454, and 505 of FIGS. 1-5 to achieve relatively larger range of flow rates than traditional pump systems can achieve. For example, the example pump systems of FIGS. 6-13 can be controlled to a fluid flow rate and/or to a fluid differential pressure across the pump within flow rates and pressure ranges that are relatively larger or wider than ranges of traditional pump systems. For example, achieving a relatively higher fluid flow rate in a traditional pumping system limits the minimum flow rate that can be achieved. Similarly, achieving a relatively lower fluid flow rate in a traditional pumping system limits the maximum flow rate that can be achieved. Unlike the traditional pump systems, the example pump systems described herein can be configured to operate at relatively lower and higher fluid flow rates.

In the illustrated examples of FIGS. 6-13, each of the pump systems includes one or more motors that may be implemented using electric motors and/or others motors or actuation devices capable of providing a torque to a driving shaft, e.g. a turbine 504 powered by the drilling fluid 109 (FIGS. 1 and 5). In the case electric motors are used, the electric motors are preferably, but not necessarily, equipped with a resolver for determining an angular position of the driving shaft. Also, the electric motors are preferably, but not necessarily, equipped with current sensor for determining, amongst other things, the torque provided by the motors at the driving shaft. In addition, each of the pump systems includes at least two pumps, which may be implemented using positive displacement pumps. The positive displacement pumps may be reciprocating pumps or progressive cavity pumps. The at least two pumps may be implemented using variable-displacement pumps (e.g., constant power pumps) or fixed-displacement pumps. For example, in some example implementations, all of the pumps of a pumping system may be implemented using variable-displacement pumps, all of the pumps may be implemented using fixed-displacement pumps, or the pumps may be implemented using a combination of variable-displacement and fixed-displacement pumps. The variable displacement pumps may be controlled using downhole electronics (via control system 210 in FIG. 2 or electronics 502 in FIG. 5 for example), by controlling the angle of a swashplate that is part of one exemplary variable displacement pump.

As discussed below, each of the pump systems of FIGS. 6-13 is configured to pump hydraulic fluid from a reservoir (similar to reservoir 420 and/or reservoir 480 shown in FIGS. 4*a*-4*b*). In addition each of the example pump systems of FIGS. 6-13 includes an output port that can be coupled to a displacement unit (e.g., the displacement unit 456 of FIG. 4B or the displacement unit 506 of FIG. 5) to draw formation fluid. Although the displacement units are not shown in FIGS. 6-13, the interested reader is referred to FIGS. 4B and 5 for illustrations of how the example displacement units 456 and 506 can be coupled to pump systems. In some example implementations, the pump systems of FIGS. 6-13 may be used to provide fluid power to devices, systems, and/or apparatus other than displacement units that are operated or controlled using hydraulic or other fluid. For example, the pump systems of FIGS. 6-13 may be fluidly coupled to hydraulic motors, pistons, extendable/retractable probes, etc. or to an actuator in the downhole tool (the drawdown pistons 412*a*, 414*a* or 416*a*, the displacement unit 456 or 506), etc). It should be noted that the types of actuators to which the pump systems of FIGS. 6-13 are connected are not limited to the shown examples. Furthermore, although the example pump systems of FIGS. 6-13 are described below as pumping hydraulic fluid and drawing hydraulic fluid from a hydraulic fluid reservoir, in other example implementations, the pump systems may be configured to pump drilling fluid (from a drilling fluid reservoir or source) or formation fluid (from a formation fluid reservoir or source).

In addition to the measurements performed on the motor (such as rotational speed, torque, angular position, for example) it may be advantageous in some cases to also measure the hydraulic fluid pressure and/or the fluid flow rate at the inlet and/or the outlet of the at least two pumps. The temperature of hydraulic fluid may also be monitored. These temperature measurements, as well as other measurements mentioned above, may be indicative of the state of the pump systems of FIGS. 6-13. All or some of these measurements can be utilized to advantage, for example displayed to an operator, and/or fed to a closed control loop of the pump system of FIGS. 6-13, as desired.

Figure 6:
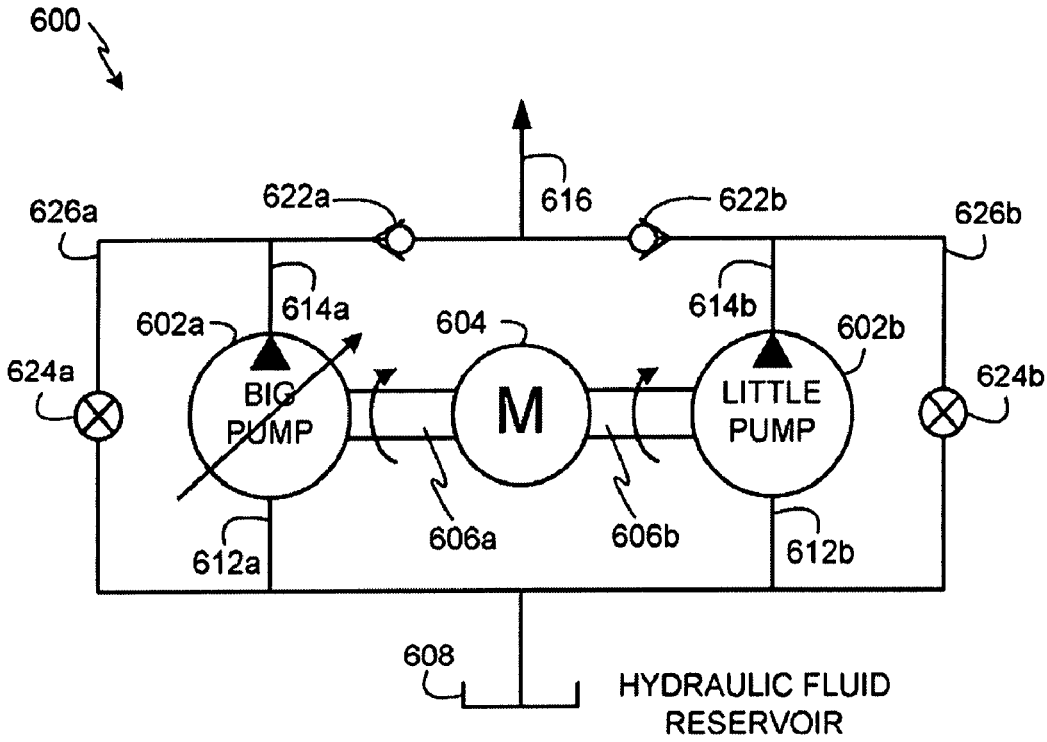
FIG. 6 is a block diagram of an example tandem pumping system that may be used to pump fluid at different flow rates and pressures.

Turning to FIG. 6, an example tandem pump system 600 is provided with two pumps 602*a*-*b* and a common motor 604 (or actuation device). In the illustrated example, the motor 604 is a dual shaft motor having a first shaft 606*a* coupled to the pump 602*a* and a second shaft 606*b* coupled to the pump 602*b*. The pump 602*a* may be implemented using a big pump or a relatively larger displacement pump and the pump 602*b* may be implemented using a little pump or a relatively smaller displacement pump. In this manner, the big pump 602*a* can be used to create relatively higher flow rates (and usually a relatively lower fluid differential pressures) and the little pump 602*b* can be used to create relatively lower fluid flow rates (and usually a higher fluid differential pressures). For example, if the combined operating range of the little pump 602*b* and the big pump 602*a* is 0-100%, then the little pump 602*b* may operate approximately in a range between 0-14% and 0-18% and the big pump 602*a* may operate approximately in a range between 12-100% and 16-100%. In other words, the small pump 602*b* may have an operating range that may be approximately ⅙ to ⅛ the operating range of the big pump 602*a* or the small pump 602*b* operating range may be approximately 1/100 to 1/10 of the upper range of the big pump 602*a*.

In the illustrated example, the motor 604 actuates both of the pumps 602*a*-*b* at the same time so that the pumps 602*a*-*b* pump hydraulic fluid simultaneously. As the pumps 602*a*-*b* are actuated, the pumps 602*a*-*b* draw hydraulic fluid from a hydraulic fluid reservoir 608 via respective ingress hydraulic fluid lines 612*a*-*b* and pump the hydraulic fluid to respective egress hydraulic fluid lines 614*a*-*b* toward an output 616. The output 616 may be coupled to another device, system, and/or apparatus that operates or is controlled using hydraulic fluid or other fluid power. For example, the output 616 can be fluidly coupled to the displacement unit 456 of FIG. 4B or the displacement unit 506 of FIG. 5. Check valves 622*a*-*b* may be provided to prevent fluid from the little pump 602*b* to flow into a pump output of the big pump 602*a* and fluid from the big pump 602*a* from flowing into a pump output of the little pump 602*b*.

To control the flow rates and pressures created by the example tandem pump system 600, the pump system 600 may be provided with 2-port, 2-position valves 624*a*-*b*, which may be controlled for example by the electronics system 502 of FIG. 5, the downhole controller 210 of FIG. 2, or the uphole controller 204 of FIG. 2. Because the motor 604 turns both of the pumps 602*a*-*b* simultaneously, the pumps 602*a*-*b* pump fluid at the same time. To control the flow rates created at the output 616 by the pumped hydraulic fluid, the valves 624*a*-*b* control the routing of the fluid from the pumps 602*a*-*b* to the output 616. For example, to create a relatively low flow rate at the output 616, the electronics system 502 or the controller 210/204 can open the valve 624*a* corresponding to the big pump 602*a* and close the valve 624*b* corresponding to the little pump 602*b*. In this manner, fluid pumped by the big pump 602*a* may be routed (or re-circulated) via a return flow line 626*a* back to the fluid reservoir 608 and/or the ingress flow line 612*a* so that the big pump 602*a* may not significantly affect the flow rate and the pressure at the output 616. By closing the valve 624*b*, the fluid pumped by the little pump 602*b* is routed to the output 616 so that the little pump 602*b* creates a relatively low flow rate at the output 616. To create a relatively high flow rate, the electronics system 502 or the controller 210/204 can close the valve 624*a* and open the valve 624*b* so that fluid pumped by the little pump 602*b* may be routed (or re-circulated) via a return flow line 626*b* back to the reservoir 608 and/or the ingress flow line 612*b* and fluid pumped by the big pump 602*a* is routed to the output 616. In some example implementations, the valve 624*a* and/or 624*b* are implemented with metering or needle valves and the electronics system 502 or the controller 210/204 may be configured to at least partially open the valve 624*a* and/or 624*b* to vary the flow rate at the output 616 by varying the amount of fluid routed from the pumps 602*a*-*b* to the output 616.

In an alternative example implementation, the valve 624*b* and the return flow line 626*b* may be omitted so that fluid pumped by the little pump 602*b* is always routed to the output 616. When a relatively low flow rate is desired at the output 616, the electronics system 502 or the controller 210/204 can open the valve 624*a* to route fluid pumped by the big pump 602*a* away from the output 616 so that the pressure and flow rate at the output 616 are based on the little pump 602*b*. When a relatively high flow rate is desired, the electronics system 502 or the controller 210/204 can close the valve 624*a* to route fluid pumped by the big pump 602*a* to the output 616. In some example implementations, the electronics system 502 or the controller 210/204 may be configured to partially open the valve 624*a* to vary the pressure and flow rate at the output 616 by varying the amount of fluid routed from the big pump 602*a* to the output 616. It should be understood that the exemplary embodiment of FIG. 6 is not limited to a particular type of valve, and that any device know in the art capable of selectively varying, restricting, allowing and/or stopping the flow in a flow line should be considered to be within the scope of this disclosure.

Figure 7:
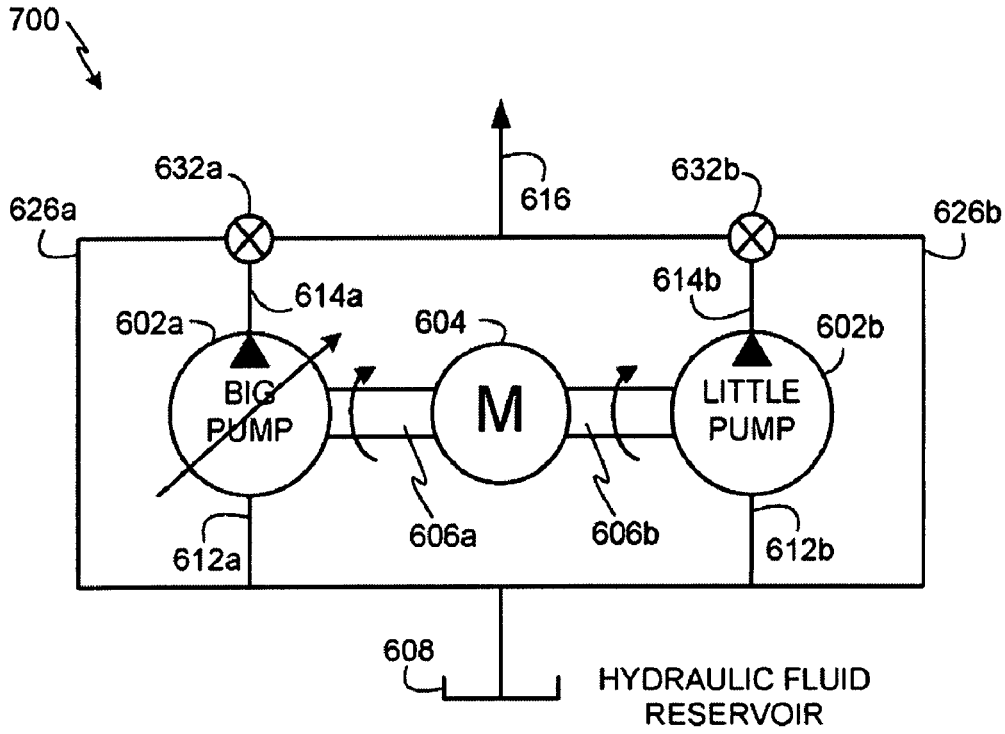
FIG. 7 is a block diagram of another example tandem pumping system that may be used to pump fluid at different flow rates and pressures.

Turning to FIG. 7, another example tandem pump system 700 is similar to the example tandem pump system 600 of FIG. 6, except that the pump system 700 is provided with 3-port, 2-position valves 632*a-b* instead of the valves 622*a-b* and 624*a-b* to control the flow rates and pressures created at the output 616. As shown, the valve 632*a* is coupled between the egress flow line 614*a*, the return flow line 626*a*, and the output 616, and the valve 632*b* is coupled between egress flow line 614*b*, the return flow line 626*b*, and the output 616. However, those skilled in the art will appreciate that hydraulic configurations may also be used. For example, the valves 632*a* 632*b* may be located between the ingress flow line 612*a*, the return flow line 626*a* and the fluid reservoir, or between the ingress flow line 612*b*, the return flow line 626*b* and the fluid reservoir respectively. Furthermore, a person having ordinary skills in the art will appreciate that a 3-port, 2 position valve may be implemented with two 2-ports, 2 positions valves. These later variations, as well as other variations are considered to be within the scope of this disclosure.

In the illustrated example of FIG. 7, to create a relatively low flow rate at the output 616, a controller, for example the electronics system 502 of FIG. 5, the downhole controller 210 of FIG. 2, or the uphole controller 204 of FIG. 2, can actuate the valve 632*a* corresponding to the big pump 602*a* to fluidly connect the egress flow line 614*a* to the return flow line 626*a* and actuate the valve 632*b* corresponding to the little pump 602*b* to fluidly connect the egress flow line 614*b* to the output 616. In this manner, fluid from the big pump 602*a* is routed (or re-circulated) via the return flow line 626*a* back to the fluid reservoir 608 and/or the ingress flow line 612*a* so that the big pump 602*a* does not affect the flow rate and the pressure at the output 616. By actuating the valve 632*b* to fluidly couple the egress flow line 614*b* to the output 616, the fluid from the little pump 602*b* is routed to the output 616 so that the little pump 602*b* creates a relatively low flow rate. To create a relatively low high flow rate, the electronics system 502 or the controller 2110/204 can actuate the valve 632*a* to fluidly connect the egress flow line 614*a* to the output 616 and actuate the valve 632*b* to fluidly connect the egress flow line 614*b* to the return flow line 626*b* so that fluid from the little pump 602*b* is routed (or re-circulated) via the return flow line 626*b* back to the reservoir 608 and/or the ingress flow line 612*b* and fluid from the big pump 602*a* is routed to the output 616. Also, both valves may be opened simultaneously. Furthermore, it should be understood that the exemplary embodiment of FIG. 7 is not limited to a particular type of valve.

In an alternative example implementation, the valve 632*b* and the return flow line 626*b* may be omitted so that fluid pumped by the little pump 602*b* is always routed to the output 616. When a relatively low flow rate is desired at the output 616, the electronics system 502 or the controller 210/204 can cause the valve 632*a* to route fluid pumped by the big pump 602*a* away, from the output 616 so that the pressure and flow rate at the output 616 are based on the little pump 602*b*. When a relatively high flow rate is desired, the electronics system 502 or the controller 210/204 can cause the valve 632*a* to route fluid pumped by the big pump 602*a* to the output 616.

Figure 8:
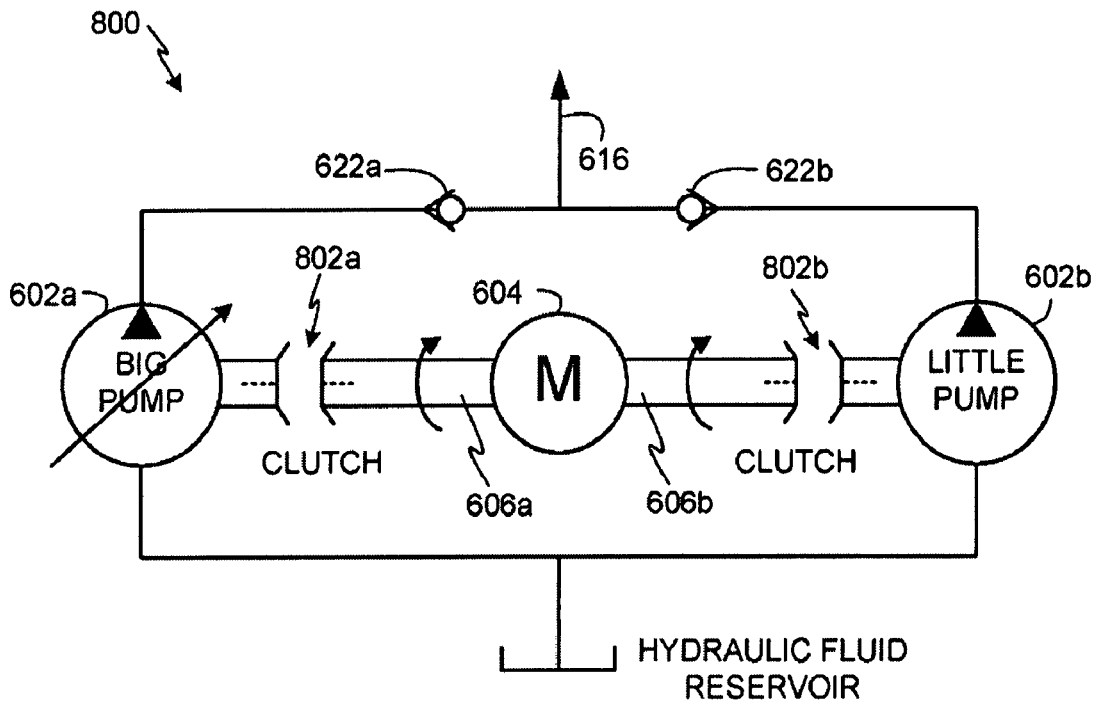
FIG. 8 is a block diagram of yet another example tandem pumping system that may be used to pump fluid at different flow rates and pressures.

Turning to FIG. 8, another example tandem pump system 800 is implemented using clutches 802*a-b*. In the illustrated example, the motor 604 is coupled to the big pump 602*a* via the clutch 802*a* and the motor 604 is coupled to the little pump 602*b* via the clutch 802*b*. In the illustrated example, valves (e.g., the valves 622*a-b*, 624*a-b*, and 632*a-b* of FIGS. 6 and 7) need not be used to control flow rates and pressures. Instead, a controller, for example the electronics system 502 of FIG. 5, the downhole controller 210 of FIG. 2, or the uphole controller 204 of FIG. 2, may be configured to selectively control (hydraulically or mechanically) the actuation of the clutches 802*a-b* to control or regulate the flow rates at the output 616. For example, to create a relatively high flow rate at the output 616, the electronics system 502 or the controller 210/204 can selectively enable or engage the clutch 802*a* corresponding to the big pump 602*a* and selectively disable or disengage the clutch 802*b* corresponding to the little pump 602*b*. To create a relatively low flow rate at the output 616, the electronics system 502 or the controller 210/204 can selectively enable or engage the clutch 802*b* and selectively disable or disengage the clutch 802*a*. In some example implementations, the electronics system 502 or the controller 210/204 may be configured to engage the clutches 802*a-b* simultaneously, thus operating the pumps 602*a-b* simultaneously to combine the fluid pumped by the pumps 602*a-b* at the output 616. In that particular configuration, check vales 622*a* and 622*b* may be desired. In some example implementations, the example tandem pump system 800 may be more efficient than the example tandem pump system 600 of FIG. 6 because in the example tandem pump system 800, the motor 604 does not need to actuate both of the pumps 602*a-b* simultaneously as is done in connection with the example tandem pump system 600.

In an alternate implementation, the motor 604 is coupled to the big pump 602*a* via the clutch 802*a* and the motor 604 is coupled to the little pump 602*b* via the shaft 606*b*. In this implementation a check valve similar to valve 602*a* may be desirable. The electronics system 502 or the controller 210/204 of FIG. 5 may be configured to selectively control (hydraulically or mechanically) the actuation of the clutch 802*a* to control or regulate the flow rates at the output 616. For example, to create a relatively high now rate at the output 616, the electronics system 502 or the controller 210/204 can selectively enable or engage the clutch 802*a* corresponding to the big pump 602*a*. To create a relatively low flow rate at the output 616, the electronics system 502 or the controller 210/204 can selectively disable or disengage the clutch 802*a*.

Those of ordinary skill in the art will appreciate that the embodiments of FIG. 6, 7 or 8 may be combined. For example, a pump system may be achieved by combining a clutch such as clutch 802*a* and a valve and return flow line such as valve 632*b* and flow line 626*b*. This later combination and other combinations are also within the scope of the present disclosure.

Figure 9:
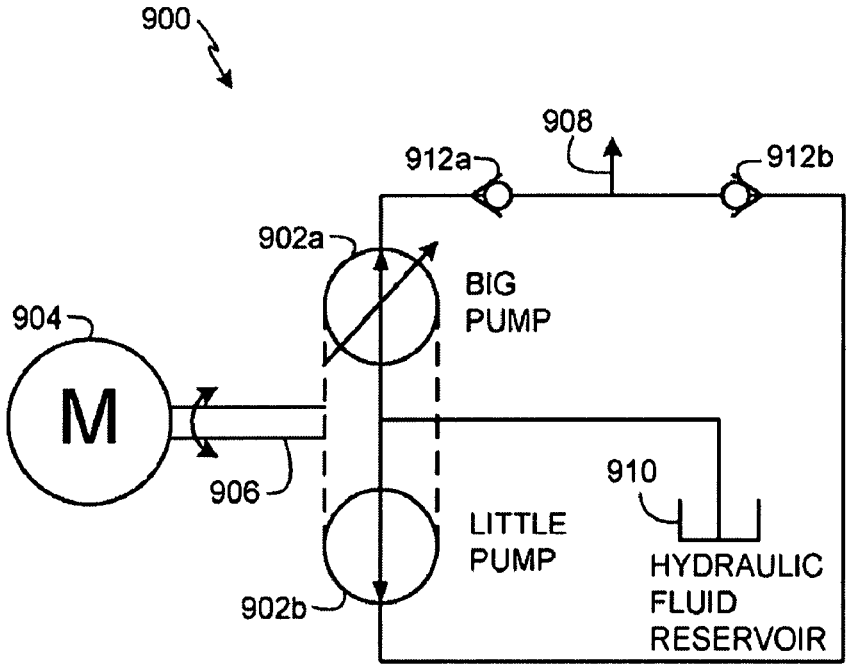
FIG. 9 is a block diagram of an example two-headed pump system that may be used to pump fluid at different flow rates and pressures.

Turning to FIG. 9, an example two-headed pump system 900 includes two pumps 902*a-b* and a motor 904 having a shaft 906 coupled to the pumps 902*a-b*. In this particular example, the pumps 902*a-b* are preferably unidirectional pumps. When driven in a first direction, the pump 902*a-b* is configured to force fluid between a pump inlet and a pump outlet. When driven in a second opposite direction, the pumps 902*a-b* are not active and do not circulate fluid. In the illustrated example, the two pumps 902*a-b* may be implemented using a dual-pump unit assembled in a single package. In particular, the pumps 902*a-b* may be coupled to the shaft 906 so that when the shaft rotates in the clockwise direction, for example, the pump 902*a* is driven in the first direction and the pump 902*b* is simultaneously driven in the second direction. The pump 902*a* may be implemented using a big pump and the pump 902*b* may be implemented using a little pump. However, the pumps 902*a-b* may be coupled to the shaft 906 so that when the shaft rotates in the counterclockwise direction, the pump 902*a* is driven in the first direction and the pump 902*b* is simultaneously driven in the second direction.

In the illustrated example of FIG. 9, the direction of rotation of the motor 904 controls the flow rates and pressures created at an output 908. For example, to create a relatively high flow rate, a controller (the electronics system 502 or the controller 210/204 for example) can cause the motor 904 to rotate in a clockwise direction to actuate the big pump 902*a* so that the big pump 902*a* pumps hydraulic fluid from a reservoir 910 to the output 908. To create a relatively low flow rate, the controller (the electronics system 502 or the controller 210/204) can cause the motor 904 to rotate in a counter-clockwise direction to actuate the little pump 902*b* so that the little pump 902*b* pumps hydraulic fluid from the reservoir 910 to the output 908. A check valve 912*a* is provided between the big pump 902*b* and the output 908 to prevent fluid pumped by the little pump 902*b* from flowing into the output port of the big pump 902*a*, and a check valve 912*b* is provided between the little pump 902*b* and the output 908 to prevent fluid pumped by the big pump 902*a* from flowing into the output port of the little pump 902*b*.

Figure 10:
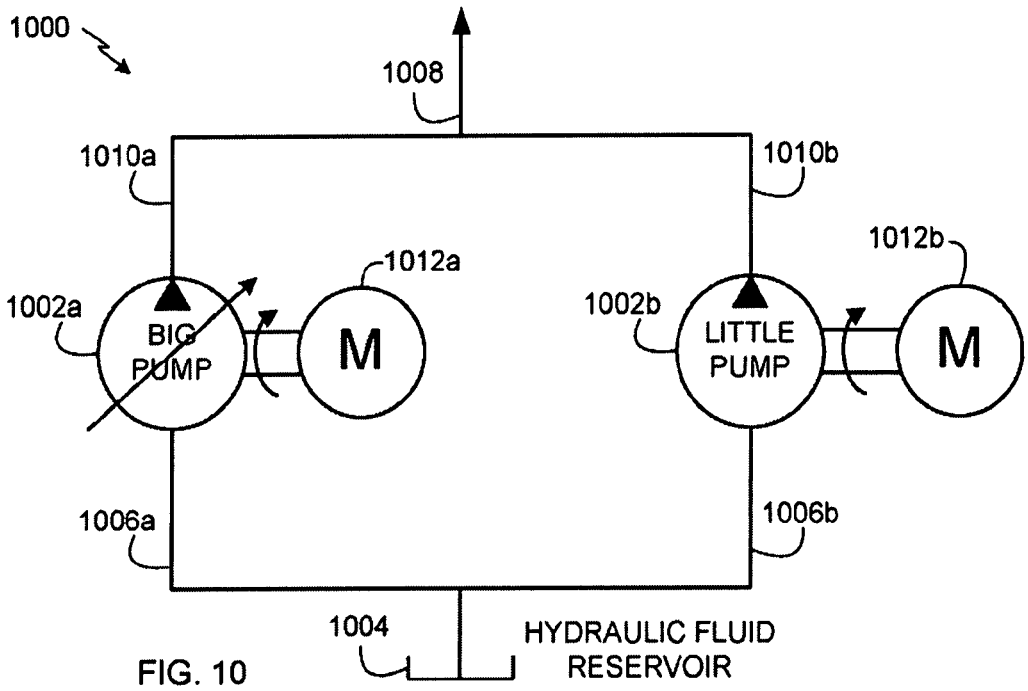
FIG. 10 is a block diagram of an example dual-motor pump system that may be used to pump fluid at different flow rates and pressures.

Turning to FIG. 10, an example dual-motor pump system 1000 includes a big pump 1002*a* and a small pump 1002*b*. The big pump 1002*a* draws hydraulic fluid from a hydraulic fluid reservoir 1004 via an ingress flow line 1006*a* and pumps the fluid to an output 1008 via an egress flow line 1010*a*. The little pump 1002*b* draws hydraulic fluid from the reservoir 1004 via an ingress flow line 1006*b* and pumps the fluid to the output 1008 via an egress flow line 1010*b*. The example pump system 1000 also includes a first motor 1012*a* coupled to the big pump 1002*a* and a second motor 1012*b* coupled to the small pump 1002*b*. In the illustrated example, the controller (the electronics system 502 or the controller 210/204) can be configured to selectively enable or actuate the motors 1012*a-b* to actuate the pumps 1002*a-b* to control the flow rates and pressures at an output 1008. For example, to create a relatively high flow rate and a relatively low fluid pressure, the controller (the electronics system 502 or the controller 210/204) can cause (e.g., selectively actuate or activate) the motor 1012*a* to rotate to actuate the big pump 1002*a* and cause the motor 1012*b* to stop rotating (e.g., selectively deactivate the motor 1012*b*) so that the big pump 1002*a* pumps hydraulic fluid from the reservoir 1004 to the output 1008. To create a relatively low flow rate and a relatively high fluid pressure, the controller (the electronics system 502 or the controller 210/204) can cause the motor 1012*b* to rotate to actuate the little pump 1002*b* and cause the motor 1012*a* to stop rotating (e.g. selectively deactivate the motor 1012*a*) so that the little pump 1002*b* pumps hydraulic fluid from the reservoir 1004 to the output 1008. In some example implementations, the controller (the electronics system 502 or the controller 210/204) may be configured to cause both of the motors 1012*a-b* to rotate to vary the pressure and flow rate at the output 1008 by varying the amount of fluid pumped by each of the pumps 1002*a-b* to the output 1008.

Figure 11:
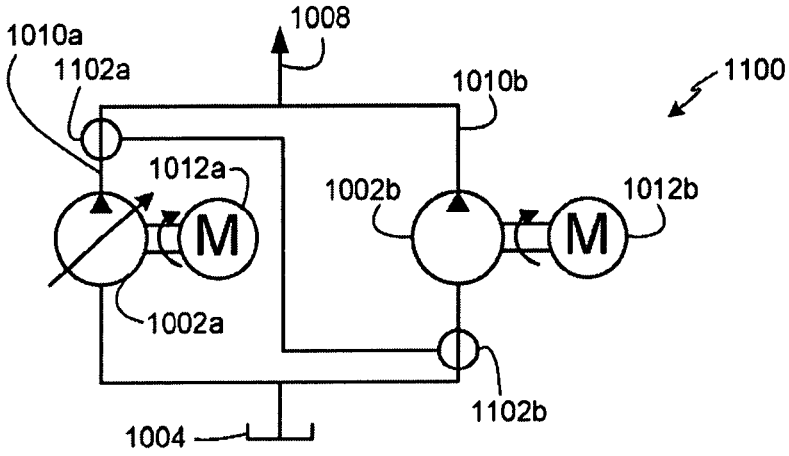
FIG. 11 is a block diagram of a parallel pumping mode configuration.
Figure 12:
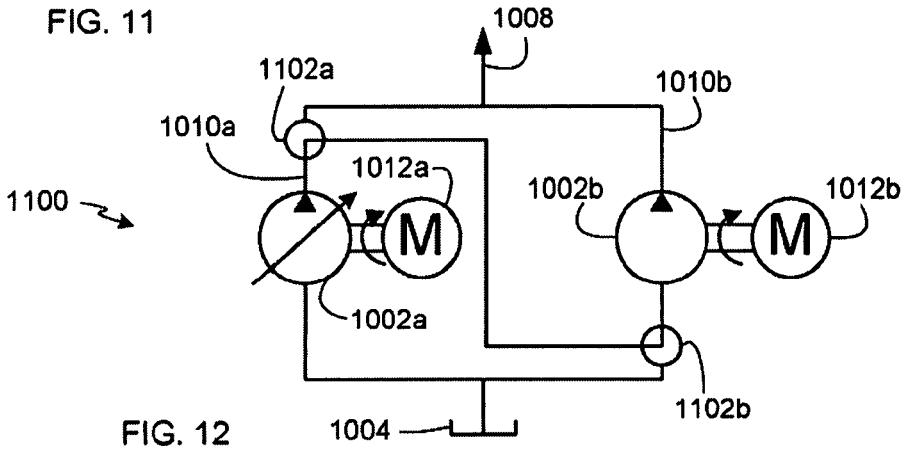
FIG. 12 depicts a series pumping mode configuration of an example parallel/series pumping system that may be used to pump fluid at different flow rates and pressures.

Turning to FIGS. 11 and 12, an example parallel/series pump system 1100 is depicted in a parallel pumping mode (FIG. 11) and a series pumping mode (FIG. 12). The example parallel/series pump system 1100 is used to increase the maximum pressure and maximum flow rate above the output characteristics of a single pump system. To achieve a maximum flow rate, the example parallel/series pump system 1100 can be configured in the parallel pumping mode depicted in FIG. 11. To achieve a lower flow rate (and a maximum pressure differential between the outlet and the reservoir), the example parallel/series pump system 1100 can be configured in the series pumping mode depicted in FIG. 12.

In the illustrated example of FIGS. 11 and 12, the parallel/series pump system 1100 is implemented by providing 3-port, 2-position valves 1102*a-b* to the dual-motor pump system 1000 (FIG. 10). In particular, the valve 1102*a* is connected in line with the egress flow line 1010*a* that fluidly couples an output of the pump 1002*a* to the output 1008, and the valve 1102*b* is connected in line with the ingress flow line 1106*b* that fluidly couples an input of the pump 1002*b* to the reservoir 1004. In the illustrated example, the controller (the electronics system 502 or the controller 210/204) can be configured to actuate the valves 1102*a-b* to selectively configure the pump system 1100 to operate in the parallel pumping mode or the series pumping mode. For example, to implement the parallel pumping mode as shown in FIG. 11, the controller (the electronics system 502 or the controller 210/204) can actuate the valve 1102*a* corresponding to the pump 1002*a* to fluidly connect the output of the big pump 1002*a* (e.g., the egress flow line 110*a*) to the output 1008 and actuate the valve 1102*b* corresponding to the pump 1002*b* to fluidly connect the reservoir 1004 to the input of the little pump 1002*b*. In this manner, both of the pumps 1002*a-b* draw fluid from the reservoir 1004 and pump the fluid to the output 1008. In the parallel pumping mode, if the big pump 1002*a* is set to displace 1.2 gallons per minute (gpm) and the little pump 1002*b* is set to displace 0.8 gpm, the total flow rate at the output 1008 is 2.0 gpm (i.e., 1.2 gpm+0.8 gpm=2.0 gpm).

To implement the series pumping mode as shown in FIG. 12, the controller (the electronics system 502 or the controller 210/204) can actuate the valves 1102*a-b* to fluidly connect the output of the pump 1002*a* (e.g., the egress flow line 1010*a*) to the input of the pump 1002*b*. In this manner, the fluid pumped by the pump 1002*a* is output to the input of the pump 1002*b* and the pump 1002*b* pumps the fluid to the output 1008. In the series pumping mode, if the input pressure to the pump 1002*a* (i.e., the pressure of the reservoir 1004) is 4000 pounds per square inch (PSI), the pump 1002*a* is set to pump at 2500 PSI, and the pump 1002*b* is set to pump at 3000 PSI, the total pressure at the output 1008 is 9500 PSI (i.e., 4000 PSI+2500 PSI+3000 PSI=9500 PSI). The pressure difference between the hydraulic fluid in the reservoir 1004 and the output 1008 is 5500 PSI (i.e., 9500 PSI-4000 PSI=5500 PSI).

In some exemplary implementations, both of the pumps 1002*a-b* may be implemented using variable displacement pumps or both of the pumps 1002*a-b* may be implemented using fixed displacement pumps. In other exemplary implementations the pump 1002*a* may be a variable displacement pump (or a fixed displacement pump) and the pump 1002*b* may be a fixed displacement pump (or a variable displacement pump respectively).

In an alternate example, one of the two motors 1012*a* and 1012*b* of FIGS. 11 and 12 is implemented and both pumps 1002*a* and 100*b* in FIGS. 11 and 12 are driven by a single shaft mechanically connected to a single motor.

Figure 13:
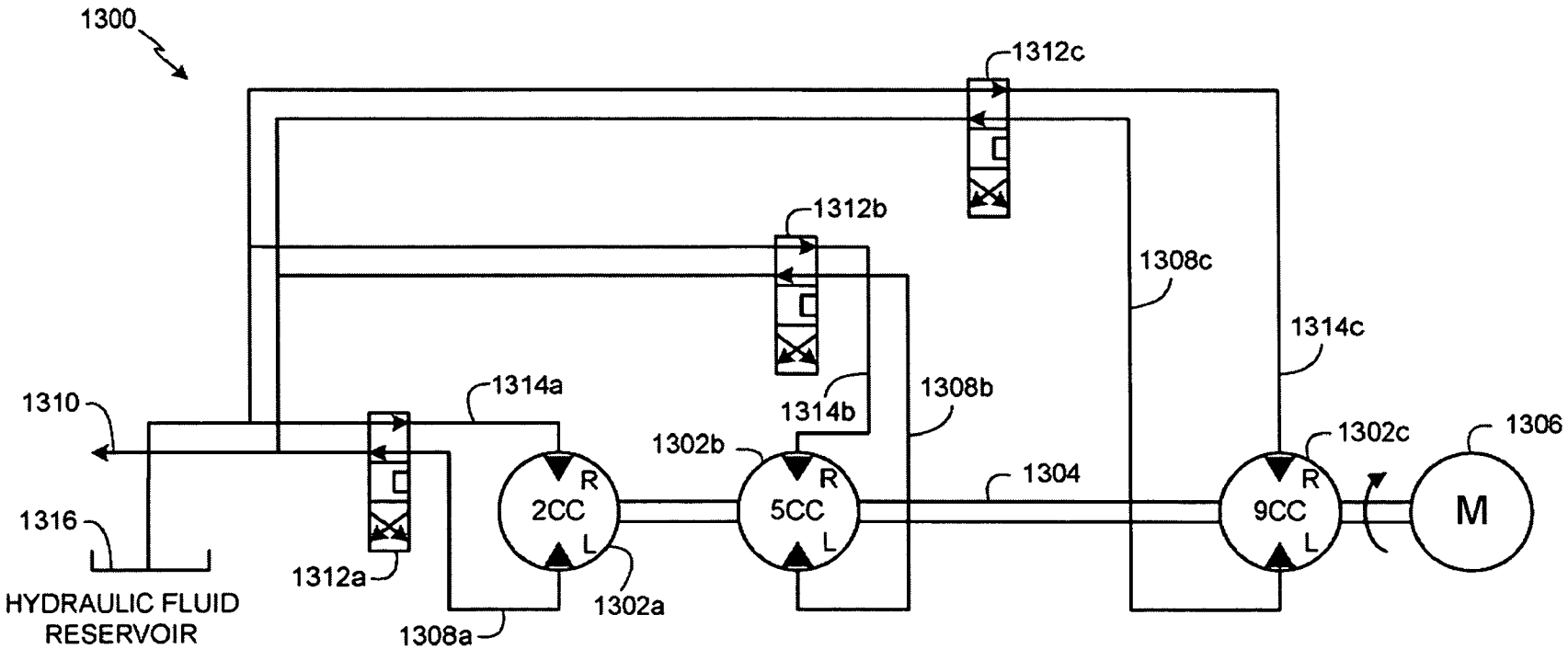
FIG. 13 is a block diagram of an example three-stage pumping system that may be used to pump fluid at different flow rates and pressures.

Turning to FIG. 13, an example three-stage pumping system 1300 includes three pumps 1302*a-c* driven by a common shaft 1304 of a motor 1306. As the motor 1306 rotates, the shaft 1304 drives all of the pumps 1302*a-c* simultaneously and the pumps 1302*a-c* continuously pump fluid out via respective egress flow lines 1308*a-c*. The example three-stage pumping system 1300 can be used to vary the flow rate at an output 1310 by selectively enabling or disabling (e.g., connecting or short circuiting) each of the egress flow lines 1308*a-c* of the pumps 1302*a-c*. To enable or disable fluid flow via the egress flow lines 1308*a-c*, the example pumping system 1300 is provided with three directional control valves 1312*a-c* fluidly connected in line with respective ones of the egress flow lines 1308*a-c* between respective pump outputs and the output 1310 of the example pumping system 1300. The directional control valves 1312*a-c* are also fluidly connected in line with ingress flow lines 1314*a-c* that fluidly couple inputs of the pumps 1302*a-c* to a hydraulic fluid reservoir 1316. In the illustrated example, the pumps 1302*a-c* are implemented using different displacement sizes. In other example implementations, the pumps 1302*a-c* may be implemented using the same displacement size.

In the illustrated example, to vary the fluid pressure and the fluid flow rate at the output 1310, the electronics system 502 or the controller 210/204 can be configured to open and close the valves 1312*a-c* to use the work performed by one of the pumps 1302*a* or to combine the work performed by one or more of the pumps 1302*a-c*. For example, to create a relatively low flow rate at the output 1310, the electronics system 502 or the controller 210/204 can manipulate the valves 1312*b* and 1312*c* to disable fluid output from the 5 CC pump 1302*b* and the 9 CC pump 1302*c* and open the valve 1302*a* to allow fluid pumped by the 2 CC pump 1302*a* to flow to the output 1310. To increase the now rate and decrease the pressure at the output 1310, the electronics system 502 or the controller 210/204 can enable fluid flow to the output 1310 from one of the larger pumps 1302*b-c* or a combination of the pumps 1302*a-c*.

Figure 14:
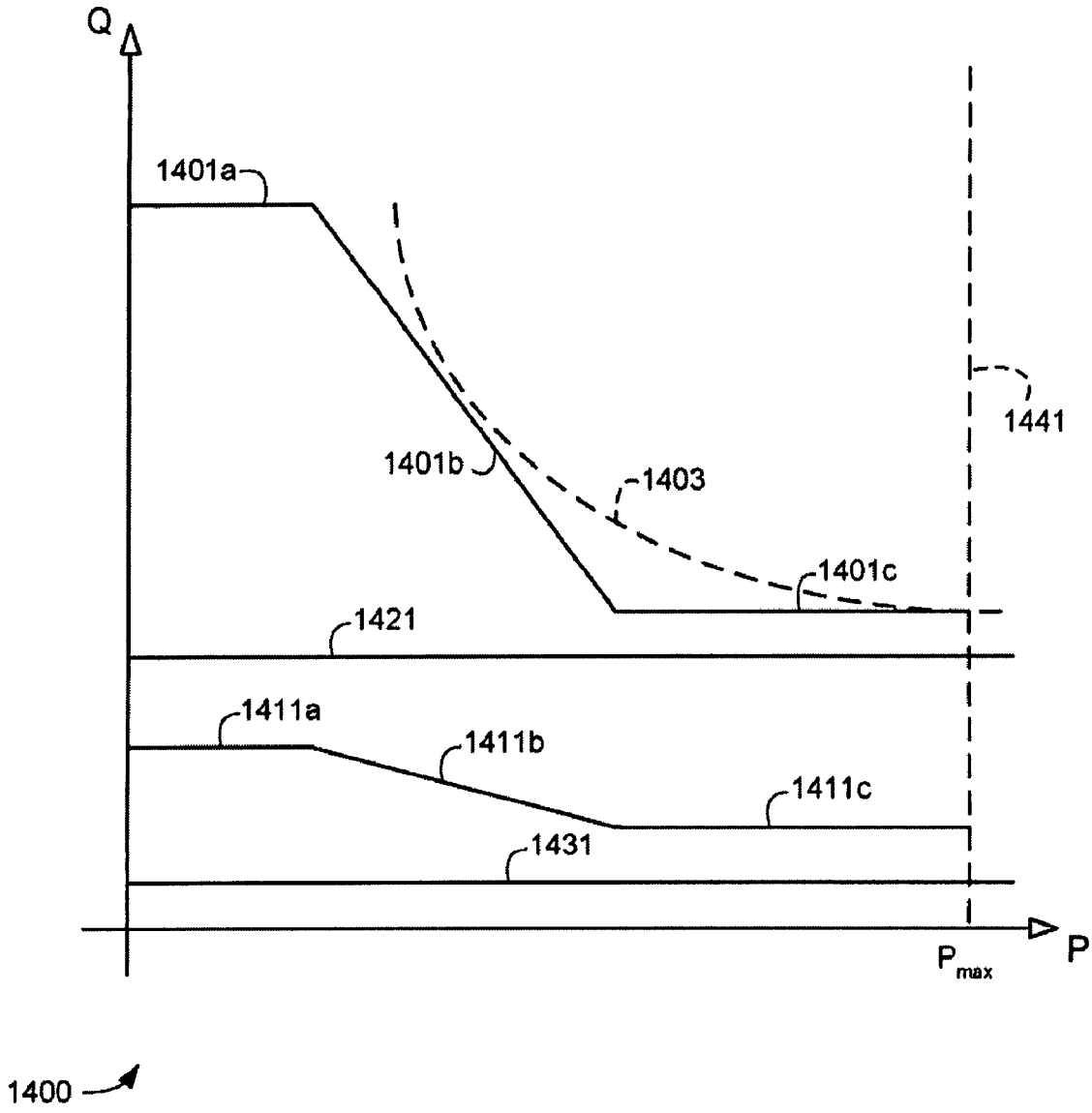
FIG. 14 is a graph illustrating an operating envelope of a pumping system using the example apparatus and methods described herein.

Referring now to FIG. 14, a graph 1400 illustrating the operating envelope or a pump system as described herein is shown. The graph 1400 represents the fluid volumetric flow rates on the y-axis versus the pressures on the x-axis at which a pump system, for example the pump system illustrated in FIG. 9, can operate as well as the fluid flow rates and the pressure differentials at which the two pumps included in the pump system can operate. The operating envelope of the various pump systems disclosed herein is not, however, limited to this particular depiction, but is rather provided for illustration purposes only while other envelopes for the pump systems may also be achieved.

The graph 1400 illustrates a curve 1401 that represents the maximum flow rate vs. pressure that can be achieved by a first pump, for example the big pump 902*a* of FIG. 9. The profile 1401 has a portion 1401*a* that corresponds to a constant flow limitation. This limitation may be deducted from the maximum rotational speed of the pump 902*a* (e.g. for preserving the lifespan of the pump). The profile 1401 also comprises a portion 1401*b* and a portion 1401*c* that are dictated by a constant power limitation 1403. This limitation may be deducted from the power available to the pump system in the downhole tool (100 in FIG. 1, 200 in FIG. 2 or 300 in FIG. 4). Preferably, the portions 1401*b* and 1401*c* closely match the dashed curve 1403, indicating the constant power limitation. However, in this embodiment, the curve portions 1401*b* and 1401*c*, deviates from the curve 1403. In particular, the portion 1401*b* corresponds to a variable displacement range, and the portion 1401*c* corresponds to a fixed displacement range.

For typical variable displacement pumps, the pump displacement, expressed in cubic centimeters per revolution, is varied with the differential pressure (on the x axis). A sensor may be provided for measuring the pressure differential across the pump and this measurement may be utilized in a feedback loop to adjust the pump displacement. For example, the pump displacement may be varied by adjusting an angle of a swash plate in the pump. In the example of FIG. 14, the swash plate angle is reduced from a maximum angle to a minimum angle along the portion 1401*b*. The swash plate angle remains at the minimum angle along the portion 1401*c*. However, it should be appreciated that other control strategies could be alternatively be used and that the cure 1401 may differ from the shown example.

The graph 1400 also illustrates a curve 1411 that represents the minimum flow rate vs. pressure that can be achieved by the first pump. The profile 1411 has a portion 1411*a* that corresponds to a constant flow limitation. This limitation may be deducted from the minimal rotational speed of the big pump 902*a* (e.g. for avoiding stalling of the pump). The profile 1411 also includes portions 1411*b* and 1411*c* that corresponds to the pump displacement variations (e.g. the swash plate angle) resulting to the pressure differential across the pump. As mentioned before, however, the big pump may be configured to operate at relatively high flow rates.

The graph 1400 further illustrates a curve 1421 that represents the maximum flow rate vs. pressure that can be achieved by a second pump, for example the small pump 902*b* of FIG. 9*a*. As shown, the second pump operates within the power limits available in the downhole tool and is only limited by its maximum rotational speed. The curve 1431 represents the minimum flow rate vs. pressure that can be achieved by the first pump. The curve 1431 corresponds to a constant flow limitation, that may be deducted from the minimal rotational speed of the pump 902*b*. The graph 1400 also shows a maximum differential pressure for the pumps by the curve 1441.

Continuing with the example, the operating envelope of the pump system now spans from low flow rates above the curve 1431 to high flow rates below the profile 1401, therefore covering a larger range of flow rates than any of the first pump or second pump ranges alone. In particular, if a flow rate lower than the limit indicated by the curve 1411 is desired, the small pump may be enabled by rotating the motor 904 in the direction associated with the small pump. If a flow rate higher than the limit indicated by the curve 1421 is desired, the big pump may be enabled by rotating the motor 904 in the direction associated with the big pump. For flow intermediate flow rates, any of the big or small pumps may be used, as desired.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An apparatus, comprising:

a downhole tool configured for conveyance within a wellbore penetrating a subterranean formation, wherein the downhole tool comprises:

a reservoir containing hydraulic fluid;

a hydraulically actuatable device including at least one chamber configured to receive pressurized hydraulic fluid;

a first hydraulic pump having an inlet fluidly coupled to the reservoir and an outlet fluidly coupled to the at least one chamber;

a second hydraulic pump having an inlet fluidly coupled to the reservoir and an outlet fluidly coupled to the at least one chamber;

at least one motor operatively coupled to at least one of the first and second hydraulic pumps; and means for selectively flowing hydraulic fluid from the outlet of at least one of the first and second pumps to the at least one chamber;

wherein a maximum flow rate of the second hydraulic pump is greater than a maximum flow rate of the first hydraulic pump.

2. An apparatus as defined in claim 1, wherein the second pump is fluidly disposed between the first pump and the reservoir.

3. An apparatus as defined in claim 1, wherein the maximum flow rate of the first pump is greater than a minimum flow rate of the second pump.

4. An apparatus as defined in claim 1, wherein the means for selectively flowing includes a clutch between the at least one motor and the second pump.

5. An apparatus as defined in claim 1, wherein the means for selectively flowing hydraulic fluid includes a first valve configured for routing at least part of the hydraulic fluid from the outlet of the second pump to one of the inlet of the second pump and the reservoir.

6. An apparatus as defined in claim 5, further comprising a second valve fluidly disposed between the second pump and the first pump, wherein the second valve is configured to prevent fluid pumped by the second pump from flowing into the first pump.

7. An apparatus as defined in claim 6, further comprising a third valve fluidly disposed between the first pump and the second pump, wherein the third valve is configured to prevent fluid pumped by the first pump from flowing into the second pump.

8. An apparatus as defined in claim 1, wherein the second pump when actuated in a first direction is configured to flow fluid and when actuated in a second direction is configured to substantially not flow fluid, and wherein the means for selectively flowing hydraulic fluid from the outlet of the second pump to the chamber include at least one shaft coupling the at least one motor to the first pump and the second pump, the at least one motor being configured to selectively rotate in one of the first and the second direction directions.

9. An apparatus as defined in claim 1 wherein the means for selectively flowing hydraulic fluid from the outlet of the second pump to the chamber include a second motor mechanically coupled to the second pump, the at least one motor and the second motor being independently actuatable.

10. An apparatus as defined in claim 1 wherein the actuatable device comprises a displacement unit including an actuation chamber for one of traversing formation fluid into and out of the downhole tool.

11. An apparatus as defined in claim 1, wherein at least one of the first pump and the second pump is a variable-displacement pump.

12. A method, comprising:

conveying a downhole tool within a wellbore penetrating a subterranean formation, wherein the downhole tool comprises:

a reservoir containing hydraulic fluid;

a hydraulically actuatable device including at least one chamber configured to receive pressurized hydraulic fluid;

a first hydraulic pump having an inlet fluidly coupled to the reservoir and an outlet fluidly coupled to the at least one chamber;

a second hydraulic pump having an inlet fluidly coupled to the reservoir and an outlet fluidly coupled to the at least one chamber, wherein a maximum flow rate of the second pump is greater than a maximum flow rate of the first pump; and at least one motor operatively coupled to at least one of the first and second hydraulic pumps;

pumping hydraulic fluid into the at least one chamber using the first pump;

pumping hydraulic fluid from the reservoir using the second pump;

actuating the first pump and the second pump via the at least one motor; and selectively pumping hydraulic fluid to the chamber using the second pump.

13. A method as defined in claim 12, further including actuating the second pump in a first direction thereby flowing fluid and actuating the second pump in a second direction thereby substantially not flowing fluid, and wherein selectively pumping hydraulic fluid to the chamber includes driving the at least one motor in one of the first and the second directions.

14. A method as defined in claim 12, wherein at least one of the first pump and the second pump is a variable-displacement pump.

15. An apparatus, comprising:

a downhole tool configured for conveyance within a wellbore penetrating a subterranean formation, wherein the downhole tool comprises:

a reservoir containing hydraulic fluid;

a hydraulically actuatable device including at least one chamber configured to receive pressurized hydraulic fluid;

a first hydraulic pump having an inlet fluidly coupled to the reservoir and an outlet fluidly coupled to the at least one chamber;

a second hydraulic pump having an inlet fluidly coupled to the reservoir and an outlet fluidly coupled to the at least one chamber, wherein a maximum flow rate of the second pump is greater than a maximum flow rate of the first pump, and wherein the second pump is configured to flow fluid when actuated in a first direction and substantially not to flow fluid when actuated in a second direction;

at least one motor configured to actuate the first and second hydraulic pumps, the motor being configured to selectively rotate in one of the first and the second directions; and a shaft operatively coupling the at least one motor and the first and the second pumps.

16. An apparatus as defined in claim 15, wherein the actuatable device is a displacement unit including an actuation chamber for one of traversing formation fluid into and out of the downhole tool.

17. An apparatus as defined in claim 15, further comprising a valve fluidly disposed between the second pump and the first pump, wherein the valve is configured to prevent fluid pumped by the second pump from flowing into the first pump.

* * * * *